US010287118B2

(12) United States Patent
Persson

(10) Patent No.: US 10,287,118 B2
(45) Date of Patent: May 14, 2019

(54) APPARATUS AND METHOD FOR FEEDING CARTON BLANKS FROM A MAGAZINE TO CARRIERS

(71) Applicant: TETRA LAVAL HOLDINGS & FINANCE S.A., Pully (CH)

(72) Inventor: Richard Persson, Hjärup (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/106,625

(22) PCT Filed: Dec. 19, 2014

(86) PCT No.: PCT/EP2014/078788

§ 371 (c)(1),
(2) Date: Jun. 20, 2016

(87) PCT Pub. No.: WO2015/091977

PCT Pub. Date: Jun. 25, 2015

(65) Prior Publication Data

US 2017/0001740 A1 Jan. 5, 2017

(30) Foreign Application Priority Data

Dec. 20, 2013 (SE) ..... 1351566

(51) Int. Cl.

| | |
|---|---|
| ***B65H 5/14*** | (2006.01) |
| ***B65H 3/08*** | (2006.01) |
| ***B65H 29/32*** | (2006.01) |
| ***B65B 43/18*** | (2006.01) |

(Continued)

(52) U.S. Cl.

CPC ..... *B65H 5/14* (2013.01); *B65B 43/185* (2013.01); *B65B 43/305* (2013.01);
(Continued)

(58) Field of Classification Search

CPC .... B65H 3/0808; B65H 3/085; B65H 3/0875; B65H 3/0883; B65H 5/12; B65H 5/14;
(Continued)

(56) References Cited

U.S. PATENT DOCUMENTS 3,242,827 A 3/1966 Winters
4,194,442 A * 3/1980 Martelli ..... B65H 3/085 271/95

(Continued)

FOREIGN PATENT DOCUMENTS

DE 44 39 723 A1 5/1996
DE 10 2005 017 962 A1 10/2006

(Continued)

OTHER PUBLICATIONS

International Search Report (PCT/ISA/210) dated Mar. 23, 2015, by the European Patent Office as the International Searching Authority for International Application No. PCT/EP2014/078788.

(Continued)

*Primary Examiner* — Ernesto A Suarez
(74) *Attorney, Agent, or Firm* — Young & Thompson

(57) ABSTRACT

An apparatus for fetching a blank from a magazine holding a number of blanks is presented. Each of the blanks is a sleeve shaped piece of packaging material folded planar. The apparatus comprises a rotary feeder provided with a gripper. The rotary feeder and the gripper are arranged to rotate around a main rotational axis, such that the gripper is moved between a fetching position in which a blank is fetched and a releasing position in which the blank is released. The gripper is arranged to rotate around a gripper specific rotational axis, such that fetching the blank in the fetching position is facilitated.

9 Claims, 12 Drawing Sheets

(51) Int. Cl.

| | |
|---|---|
| ***B65B 43/30*** | (2006.01) |
| ***B65B 43/32*** | (2006.01) |
| *B31B 50/06* | (2017.01) |
| *B31B 50/80* | (2017.01) |
| *B31B 100/00* | (2017.01) |

(52) U.S. Cl.
CPC ..... *B65B 43/325* (2013.01); *B65H 3/085* (2013.01); *B65H 3/0808* (2013.01); *B65H 3/0875* (2013.01); *B65H 29/32* (2013.01); *B31B 50/06* (2017.08); *B31B 50/062* (2017.08); *B31B 50/804* (2017.08); *B31B 2100/0022* (2017.08); *B65H 2406/34* (2013.01)

(58) Field of Classification Search
CPC ..... B65H 29/28; B65H 29/32; B65H 33/18; B65H 2405/53; B65H 2405/531; B65H 2405/54; B65H 2405/541; B65H 2405/55; B65H 2405/551; B65H 2405/552; B65H 2405/583; B65H 2405/584; B65H 2406/34; B65B 43/185; B65B 43/305; B65B 43/325; B31B 50/804; B31B 50/062; B31B 2100/0022
See application file for complete search history.

(56) References Cited

U.S. PATENT DOCUMENTS

| | | | | | |
|---|---|---|---|---|---|
| 5,456,570 | A * | 10/1995 | Davis, Jr. | B65G 47/915 | 271/107 |
| 5,653,671 | A * | 8/1997 | Reuteler | B65H 1/24 | 271/150 |
| 5,715,657 | A * | 2/1998 | Mondani | B31B 5/80 | 493/313 |
| 6,101,787 | A * | 8/2000 | Brintazzoli | B65B 43/185 | 271/11 |
| 6,325,201 | B1 * | 12/2001 | Bailey | B65B 19/228 | 198/471.1 |
| 7,976,449 | B2 * | 7/2011 | Klein | B65B 43/185 | 493/309 |
| 8,047,530 | B2 * | 11/2011 | Harston | B65B 43/185 | 271/100 |
| 2008/0227612 | A1 | 9/2008 | Harston | | |

FOREIGN PATENT DOCUMENTS

| | | | |
|---|---|---|---|
| EP | 0 705 684 | A1 | 4/1996 |
| JP | 61-232130 | A | 10/1986 |
| JP | 2005-271970 | | 10/2005 |
| WO | WO 2005/019074 | A1 | 3/2005 |

OTHER PUBLICATIONS

Written Opinion (PCT/ISA/237) dated Mar. 23, 2015, by the European Patent Office as the International Searching Authority for International Application No. PCT/EP2014/078788.

Japanese Office Action dated Oct. 23, 2018 in corresponding Japanese Patent Application No. 2016-541266 with JPO machine translation of Japanese Office Action.

* cited by examiner

APPARATUS AND METHOD FOR FEEDING CARTON BLANKS FROM A MAGAZINE TO CARRIERS

TECHNICAL FIELD

Methods and apparatuses for feeding carton blanks from a magazine to carriers are presented. More particularly, it is presented methods and apparatuses comprising at least one rotary feeder for fetching blanks from the magazine, erecting them and placing them in a carrier.

BACKGROUND

In the field of carton based packaging for liquid food products, there are generally two main types of systems; roll fed systems and blanks fed systems. An example of roll fed systems is Tetra Brik™ marketed by Tetra Pak, and an example of blanks fed systems is Tetra Recart™ or Tetra Rex™, both marketed by Tetra Pak.

In the roll fed systems, a roll of packaging material is fed to the system. The roll is shaped into a tube, which in turn is filled with a liquid food product. By successively making transversal sealings in the lower part of the tube and cutting of the lower part of the tube packages can be formed.

In the carton blanks fed systems, the packaging material is prepared before being fed to the system by cutting this into pieces, wherein each piece corresponds to one package, and by providing a longitudinal sealing such that each piece is shaped into a sleeve-shaped body. In order to facilitate folding, weakening lines may be provided in the packaging material. The sleeve shaped packaging material pieces are usually referred to as blanks.

In the filling machine these are placed in a magazine, usually in an upright position such that the openings are placed vertically. According to one way of operating a blanks fed system, a blank is fetched from the magazine, erected and placed in a cassette providing for that blank is kept in a position such that a sleeve with a rectangular cross section is formed. Thereafter, one end of the sleeve is closed and sealed such that a package with an open end is formed. Next, the package is filled with a liquid product via the open end, and finally the open end of the package is sealed and closed.

Usually the blanks are produced at one site, sometimes referred to as a converting factory, and transported to another site where the filling system is placed. During the transportation there is a risk that the blanks are squeezed together such that inner sides of the blanks stick to each other and that close lying blanks stick to each other. Therefore, faced with this reality, it is a challenge to make sure that the blanks can be fetched from the magazine at high speeds, i.e. fetching more than one blank per second, and in a robust way, i.e. causing few unwanted interruptions.

SUMMARY

Accordingly, the methods and apparatuses described herein preferably seeks to mitigate, alleviate or eliminate one or more of the above-identified deficiencies in the art and disadvantages singly or in any combination and solves at least the above mentioned problems.

According to a first aspect it is provided an apparatus for fetching a blank from a magazine holding a number of blanks, each of said blanks being a sleeve shaped piece of packaging material folded planar, said apparatus comprising a rotary feeder provided with a gripper, wherein said rotary feeder and said gripper are arranged to rotate around a main rotational axis (MR), such that said gripper is moved between a fetching position in which a blank is fetched and a releasing position in which said blank is released, and wherein said gripper is arranged to rotate around a gripper specific rotational axis (GR), such that fetching said blank in said fetching position is facilitated.

A gripper cam curve can be provided for controlling rotation of said gripper around said gripper rotational (GR) axis when said rotary feeder is rotated around said main rotational (MR) axis.

The rotary feeder may be arranged to rotate around said main rotational (MR) axis in a main rotational direction, and said gripper may be arranged to rotate around said gripper specific rotational (GR) axis in a gripper specific rotational direction, wherein said main rotational direction is opposite to said gripper specific rotational direction during a time period starting at a fetching point of time.

The time period starting at said fetching point of time may be less than a time period for said rotary feeder to rotate one turn around said main rotational axis.

The rotary feeder may be arranged to rotate around said main rotational (MR) axis in a main rotational direction, and said gripper may be arranged to rotate around said gripper specific rotational (GR) axis in a gripper specific rotational direction, wherein said main rotational direction is the same as said gripper specific rotational direction during a time period starting before a fetching point of time.

The time period starting before the fetching point of time may end at the fetching point of time, that is, when the blank is fetched by the gripper.

The time period starting before the fetching point of time may be less than said time period for said rotary feeder to rotate one turn around said main rotational axis.

The gripper may comprise a gripper head, wherein said gripper head may be arranged to rotate around a gripper head specific rotational (GHR) axis.

A gripper head cam curve may be provided for controlling rotation of said gripper head around said gripper head rotational (GHR) axis when said rotary feeder is rotated around said main rotational (MR) axis.

According to a second aspect it is provided a method for fetching a blank from a magazine holding a number of blanks, each of said blanks being a sleeve shaped piece of packaging material folded planar, said method comprising rotating a rotary feeder provided with a gripper around a main rotational axis, such that said gripper is moved between a fetching position in which said blank is fetched and a releasing position in which said blank is released, rotating said gripper around a gripper specific rotational axis (GR), such that fetching said blank in said fetching position is facilitated.

A gripper cam curve may be provided for controlling rotation of said gripper around said gripper rotational axis when said rotary feeder is rotated around said main rotational axis.

The rotary feeder may rotate around said main rotational axis in a main rotational direction, and said gripper rotates around said gripper specific rotational axis in a gripper specific rotational direction, wherein said main rotational direction is opposite to said gripper specific rotational direction during a time period starting at a fetching point of time.

The time period starting at the fetching point of time may be less than said time period for said rotary feeder to rotate one turn around said main rotational axis.

The rotary feeder may rotate around said main rotational (MR) axis in a main rotational direction, and said gripper may rotate around said gripper specific rotational (GR) axis in a gripper specific rotational direction, wherein said main rotational direction is the same as said gripper specific rotational direction during a time period starting before a fetching point of time.

The time period starting before the fetching point of time may end at the fetching point of time, that is, when the blank is fetched by the gripper.

The time period starting before the fetching point of time may be less than said time period for said rotary feeder to rotate one turn around said main rotational axis.

The gripper may comprise a gripper head, wherein said gripper head is arranged to rotate around a gripper head specific rotational (GHR) axis.

A gripper head cam curve may be provided for controlling rotation of said gripper head around said gripper head rotational (GHR) axis when said rotary feeder is rotated around said main rotational axis.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION OF PREFERRED EMBODIMENTS

Figure 1:
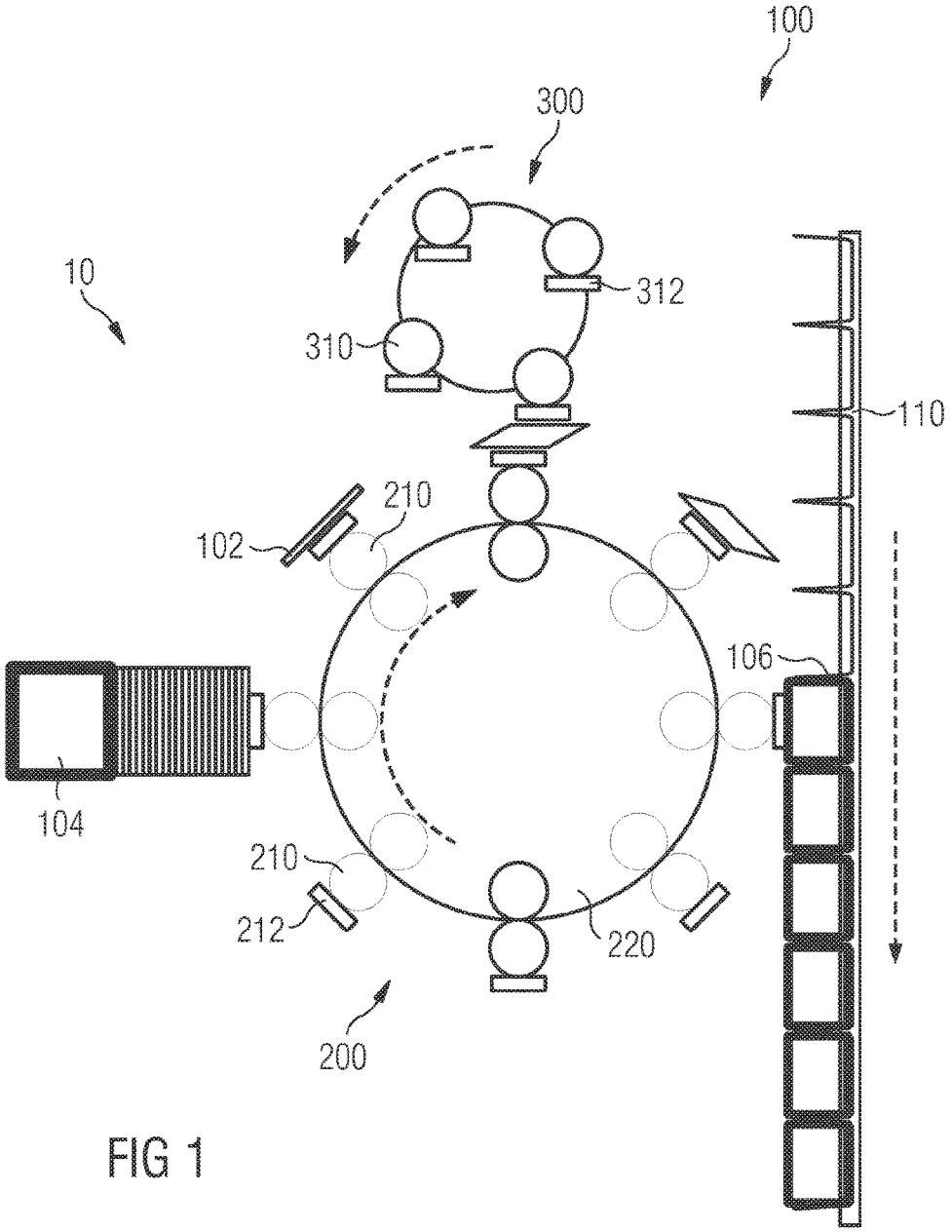
FIG. 1 is a schematic view of an infeed unit.

Starting with FIG. 1, a rotary infeed apparatus 100 is shown. The infeed apparatus 100 may form part of a larger plant 10, such as a filling system for packaging of food into individual packages, such as carton based packages.

The main purpose of the rotary infeed apparatus 100 is to transport folded package blanks 102 from a magazine, or supply 104, to individual carriers 106. Once positioned in a carrier 106, the blank 102 is partly sealed in order to form a semi-finished package, whereafter it is filled with a product before sealing the end being still open. Hence, the rotary infeed system 100 may preferably be arranged upstream, or before a first sealing unit, a filling unit, and a second sealing unit. Additional equipment of the filling system 10 may e.g. include various distribution units, batch autoclaves, and transporting and packing units.

The main components of the rotary infeed apparatus 100 are the magazine 104, a rotary feeder 200, optionally a carousel 300, and a stream of individual carriers 106.

As previously mentioned, the magazine 104 stores a plurality of stacked blanks 102. Each blank 102 forms a box-like structure having open ends, however it is folded such that a planar body is provided. By operating the infeed apparatus 100 the folded blank 102 is fetched from the magazine 104 and released into the carrier 106. The rotary infeed apparatus 100 also provides a shape adjustment, such that the carrier accommodates an open-ended box-like package.

Transport and forming is achieved by a rotary feeder 200 in cooperation with a carousel 300. For this, the rotary feeder 200 has a driving unit 220 which provides a rotational movement of the feeder 200. At least one gripper 210 is arranged at the outer periphery of the feeder 200 and includes one or more suction cups 212 which are securing the blank 102 to the gripper 210 when suction is applied, through connection to a vacuum source. Hence, by removing the suction the gripper 210 will release the article, or semi-finished package, to a carrier.

As illustrated in FIG. 1 the gripper 210 can engage with the blank 102 at the position of the magazine 104, whereby the gripper 210 removes the blank 102 from the magazine 104 as the feeder 200 rotates. Somewhere between the receiving position, i.e. the position when the gripper 210 faces the magazine 104, and the release position, i.e. the position when the gripper 210 faces the carriers 106, the carousel 300 is arranged. The carousel 300 can be provided with secondary grippers 310, also being provided with one or more suction cups 312. The position of the carousel 300 can be provided such that the secondary gripper 310 will be allowed to engage with the blank 102 being carried by the gripper 210 of the feeder 200. Due to a difference in relative motion between the gripper 210 of the feeder 200 and the secondary gripper 310 of the carousel 300 the blank 102 will be forced to adapt its shape, as is indicated in FIG. 1. Pre-made creasing lines in the blank 102 can facilitate proper shape adjustment of the blank 102.

The secondary gripper 310 can be controlled to release the suction force at a predetermined position, such that the gripper 210 of the feeder 200 can continue to transport the blank 102 towards the carriers 106. During this movement the shape of the blank 102 will be substantially the same as when the secondary gripper 310 releases the blank 102, although some flexibility of the blank 102 may be provided.

The carriers 106 can be transported by a conveyor 110 to and from the release position of the feeder 200, such that the blank 102 may be released in an empty carrier by releasing the suction from the suction cups 212 of the gripper 210.

In order to operate the infeed unit 100 at high speed it is desirable that the movements of the blanks 102 are extremely accurate in terms of position and angle relative the cooperating components, i.e. the magazine 104, the carousel 300, and the carriers 106. The rotary feeder 200 can allow for secure separation and erecting of carton based packages more or less independent of the shape and friction of the blank material. Further to this, the rotary feeder 200 can allow for preparation of the blank 102 in order to ensure proper opening, forming, and sealing of the package. Additional advantages include increased robustness, a reduced number of components, designed for high speed applications, reduced cost, increased hygiene, as well as improved visibility.

One idea of the rotary feeder 200 is to provide two cams, or guiding tracks, making it possible to locally influence the speed and angle of the suction cups 212 of the grippers 210 independently of each other at all positions during a revolution. This makes it possible to adjust the movements so in full speed the suction cups 212 will make a non-rotating linear movement without sliding against counter surfaces. It is further possible to control the angle of the suction cups 212 in an optimal manner. The provision of the two guiding tracks further allows for speed and angle adjustment so as to have a synchronized or customized movement of the grippers 210 for a certain time relative other components, allowing for proper pre-opening and release of the blank 102.

Figure 2:
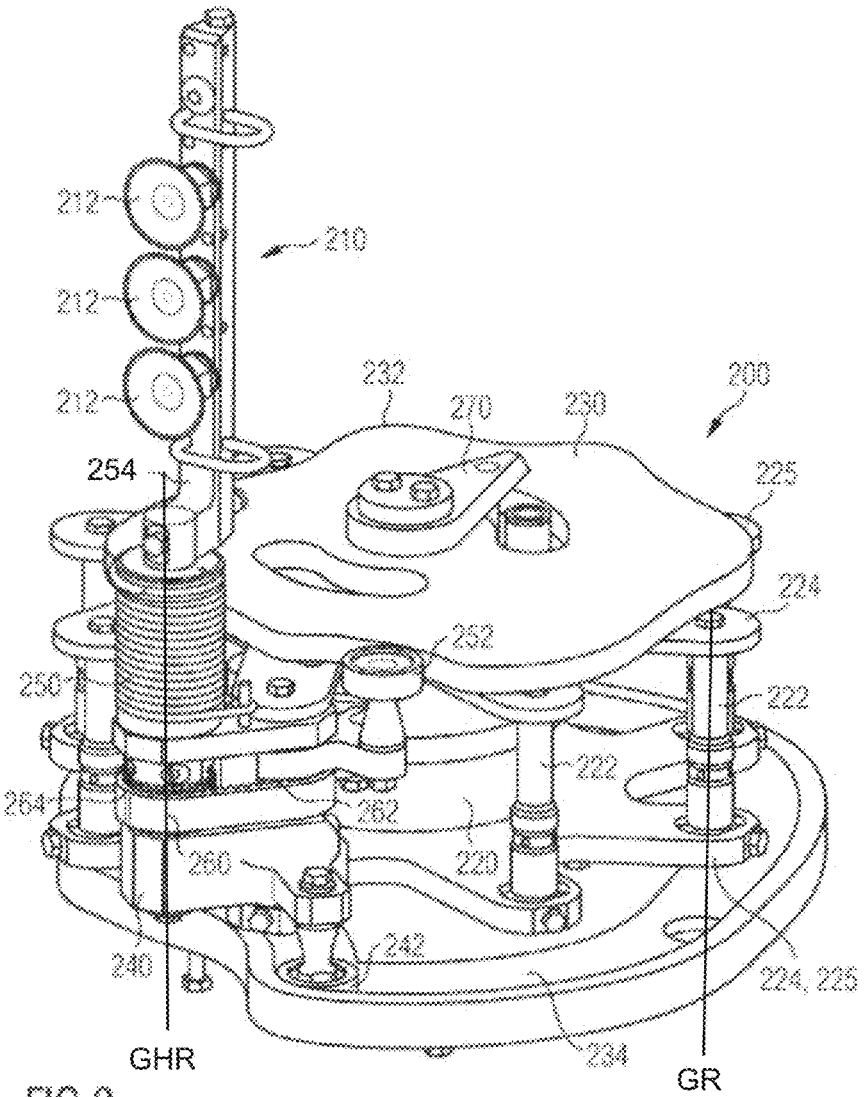
FIG. 2 is an isometric view of an example of a rotary feeder.

Now turning to FIG. 2 in which the feeder 200 is illustrated in further detail. The feeder 200 can comprise a number of supports 222 being fixedly attached to the driving unit 220. Hence, when the driving unit 220 is running the supports 222 will be rotating accordingly. Each support can be configured to be connected to a gripper 210, although only one gripper 210 is illustrated in FIG. 2. Since eight supports 222 are provided, it would be possible to connect one gripper 210 to each support 222.

The driving unit 220 forms a casing having upper and lower flanges 224. The supports 222 extend between the flanges 224 in a vertical direction. The flanges 224 extend radially outwards from the center, and they are formed as several spaced apart protrusions 225 in order to allow the grippers 210 to move radially inwards relative the drive unit 220.

A guide assembly 230 is fixedly attached to a frame of the feeder 200, and has an upper guiding track 232 forming a cam curve, being attached to the frame through a stationary axle, and further has a lower guiding track 234 also forming a cam curve, being directly attached to the frame.

Each gripper 210 is arranged in engagement with the guide assembly 230 and has a base structure 240 and a receiving unit 250. The receiving unit 250 extends vertically upwards from the base structure 240 and includes the suction cups 212.

One end of the base structure 240 is pivotally connected to an associated support 222, such that the base structure 240 will move as the support 222 is moving. However, since the receiving unit 250 extends from the opposite end of the base structure 240 the position of the receiving unit 250 relative the support 222 may vary due to pivoting.

The base structure 240 is further provided with a lower roller 242, or any other low friction element, which engages with the lower guiding track 234. Hence, as the lower roller 242 is following the cam curve of the lower guiding track 234 the position of the receiving unit 250 relative the support 222 will change, both radially and peripherally.

The receiving unit 250 is pivotally arranged relative its own vertical axis. Further, an upper roller 252 is provided which engages with the cam curve of the upper guiding track 232. A transmission 260 is further provided for causing a pivoting movement of the receiving unit 250 due to a radial change in position between the upper roller 252 and the vertical axis of the support 222.

The transmission 260 can be formed as a toothed belt engaging with a first gear 262 connected to the upper roller 252, and a second gear 264 being connected to a vertical shaft 254 of the receiving unit 250. The gear ratio is preferably 1:1. The suction cups 212 are arranged on the vertical shaft 254 such that the engagement surface of the suction cups 212 coincides with the vertical axis of the receiving unit 250, and this is defined as the vertical axis of the suction cups 212.

The receiving unit 250 is spring biased such that a rotation in a clockwise direction, as seen from above, of the suction cups 212 will be counteracted by a spring force. Hence, the upper roller 252 is constantly pressed against the cam curve of the upper guiding track 232. The base structure 240 is also spring-biased, such that the lower roller 242 is pressed against the outside of the cam curve of the guiding track 234. The same spring may be used for spring-biasing both the upper and lower rollers 242, 252.

Operation of the feeder 200 will now be described. The feeder 200 is operated in order to rotate one or several grippers 210, such that a blank 102, or any other article, may be picked up at a receiving position and released at a release position. Hence, each one of the grippers 210 will all be subject to the same movement, although it occurs at different times as the feeder 200 rotates. The described feeder 200 is thus of a general character, and it could be enlarged or made smaller in order to rotate an increased number of grippers 210 as well as a reduced number of grippers 210. In FIG. 2, a feeder 200 being able to carry eight grippers 210 is shown, although only one gripper 210 is illustrated.

The vacuum is provided to the suction cups 212 by channels inside the frame, through a swivel to which each gripper connects and disconnects, upon movement around the drive unit.

As can be seen in FIG. 2 the position of the gripper 210 can be defined by three different inputs. The first input, i.e. coming from the drive unit 220, defines the general angular position of the gripper 210 relative its surroundings. The second input, i.e. coming from the lower guiding track 234, defines the position of the gripper 210 relative the drive unit 220, both in view of angular position and radial position. The third input, i.e. coming from the upper guiding track 232, defines the angle of the suction cups 212 relative the frame, and this angle can be controlled independently from the position of the gripper 210.

Should the lower guiding track be circular, the second input should make no contribution to a change in movement of the gripper 210. However, by constructing the lower guiding track 234 as a non-circular cam curve, the speed of the gripper 210 will vary during the revolution. Referring to the gripper position shown in FIG. 2, and assuming a clockwise rotation, the lower roller 242 has just been following a portion of the lower guiding track 234 having an increased radius relative the drive unit 220. Hence the gripper 210 has been forced to pivot relative its support 222 such that the suction cups 212, being arranged at an opposite end compared to the lower roller 242, is in a forward position. When the lower roller 242 is brought to a position having a decreased radius, the lower roller 242 will pivot the base structure around its associated support 222, such that the suction cups 212 consequently will pivot backwards (or against the rotation of the drive unit 220). Since the radial position of the suction cups 212 will vary due to the back-and-forth pivotal movement around the support 222, it is actually possible to have the suction cups 212 at a constant angular position during some time even when the drive unit 220 rotates.

The suction cups 212 will preferably need to come into contact with the adjacent article or blank 102, as well as an adjacent carrier 106, in a fully linear movement in order to not to cause any sliding effect between the suction cups 212 and the blank 102, or between the blank 102 and the carrier 106. The linear movement should preferably be in a radial direction, which means that the angle of the suction cups 212 should be constant during the linear movement. For this, the upper guiding track 232 is provided. The upper roller 252 follows the upper guiding track 232 in the same manner as the lower roller 242 follows the lower guiding track 234. By constructing the upper guiding track 232 as a non-circular cam curve the angle of the suction cups 212 will depend on whether the upper roller 252 is at a large or small radius on the upper guiding track 232.

The exact shape of the upper and lower guiding tracks 232, 234 could of course be varied in a vast amount of ways, but should be selected such that the motion of the gripper 210 is suitable in view of adjacent components such as blank magazines 104, forming carousels 300, and carriers 106.

An adjustment mechanism 270 may be provided. The adjustment mechanism allows for an easy adjustment of the position when the vacuum of the suction cups 212 should be disengaged, and the suction cups 212 hence release the sleeve in the carrier 106. A pusher 216 may be provided at a top and/or bottom of the gripper 210. This pusher 216 acts to push the carton blank into the carrier 106. The pushers 216 can be arranged at a position which is above and/or underneath the carriers 106, such that they cannot come into contact with each other, should something malfunction in the machine. With the pusher 216 installed on the gripper 210, the grippers can be configured to always travel outside the path of the carriers 106, and no interference is hence possible between the grippers 210 and the carriers 106.

A guide may be arranged in a fixed position, adjacent the conveyor 108, above and/or below the carriers 106. When the pusher 216 has pushed a sleeve into a carrier 106, the guide 108 engages the sleeve and additionally guides the sleeve into the carrier 106 and ensures that it ends up in the right position. The guide can be a simple mechanical arrangement, having a first angled surface, for bringing the sleeve into the carrier 106, and a second straight surface, being parallel to the travel direction of the conveyor 110.

Through the provision of two cam curves, of the upper and lower guiding tracks 232, 234, the gripper 210 can be given an oscillating movement, rather than a fully rotational movement. The oscillating movement enables more grippers 210 to be placed on the feeder 200, since they require less space. This makes the feeder more compact.

When the suction cups 212 are attached to a carton blank at the magazine 104, the gripper 210 can be first pivoted outwards, such that a first side of the blank is still held by a hook of that side, and a second side of the blank is brought away from the magazine 104. The gripper 210 can then rotate with the drive unit 220 towards the carousel 300 and the conveyor 110. The movement of the gripper 210 during the reception (or picking) of a blank is hence a) straight movement into contact with a blank, b) pivoting movement of the gripper 210 around the vertical axis of the suction cups such that a downstream end of the blank is released from hooks of the magazine 104, and c) rotational movement along a circular path as driven by the drive unit 220 towards the carousel and/or conveyor 110.

The carriers 106 may be provided with angle projections at an open end thereof, facing the feeder 200 during the loading of sleeves (i.e. opened blanks). These angle projections serve to hold the opened sleeves firmly inside the carriers 106, even at high speeds.

The vertical shaft 254 may designed such that the gripper 210 with the suction cups 212 is not only offset a first distance in a first direction, also referred to as a first offset, with respect to a rotational axis of the gripper 210 relative the base structure 240, as illustrated in FIG. 2, but also a second distance in a second direction, also referred to as a second offset, wherein the second direction is perpendicular, or at least non-parallel, to the first direction. The first offset can be designed such that the suction cups 212, at the moment when fetching the blank 102 from the magazine, can reach the blank 102 easily, but without pushing the blank 102 towards the other blanks in the magazine. The second offset, not illustrated in FIG. 2, can provide for that the suction cups 212 can suck onto, or grip, the blank in a more reliable manner. More particularly, when not having the second offset, the suction cups will be turned steeply towards the blank with the risk that one or several of the suction cups are folded, in turn resulting in that the blank will not be gripped properly. Therefore, by having the second offset, the risk of folding the suction cups is reduced.

FIGS. 3*a* to 3*d* illustrate four differents snapshots of an example of a process for fetching the blank 102 from the magazine 104. In this example the gripper 210 with the suction cups 212 are offset both in the first and second direction, as discussed above.

Figure 3A:
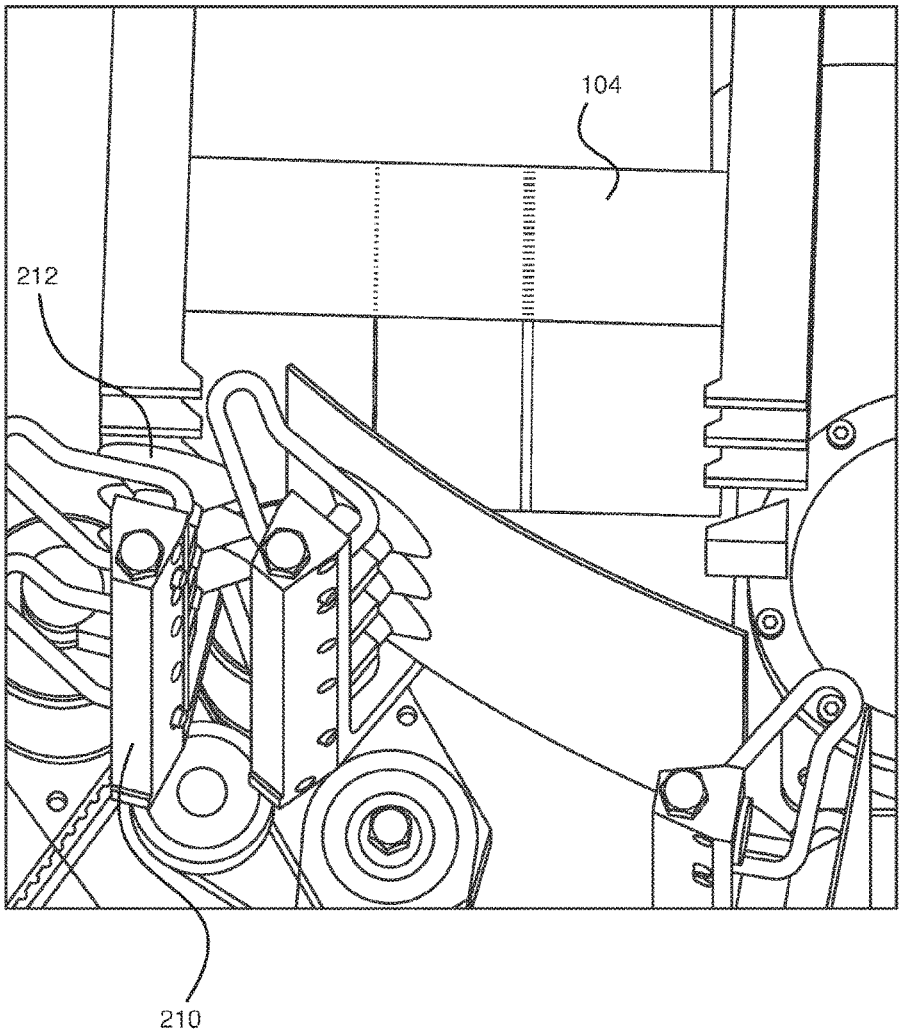
FIG. 3*a-d* is an illustration of a process for fetching blanks from a magazine.

In FIG. 3*a* the gripper 210, placed to the left in the figure, is moved towards the blank at the same time as the orientation of the suction cups 212 is changed towards a situation where these are parallel to the blank 102 in the magazine 104.

Figure 3B:
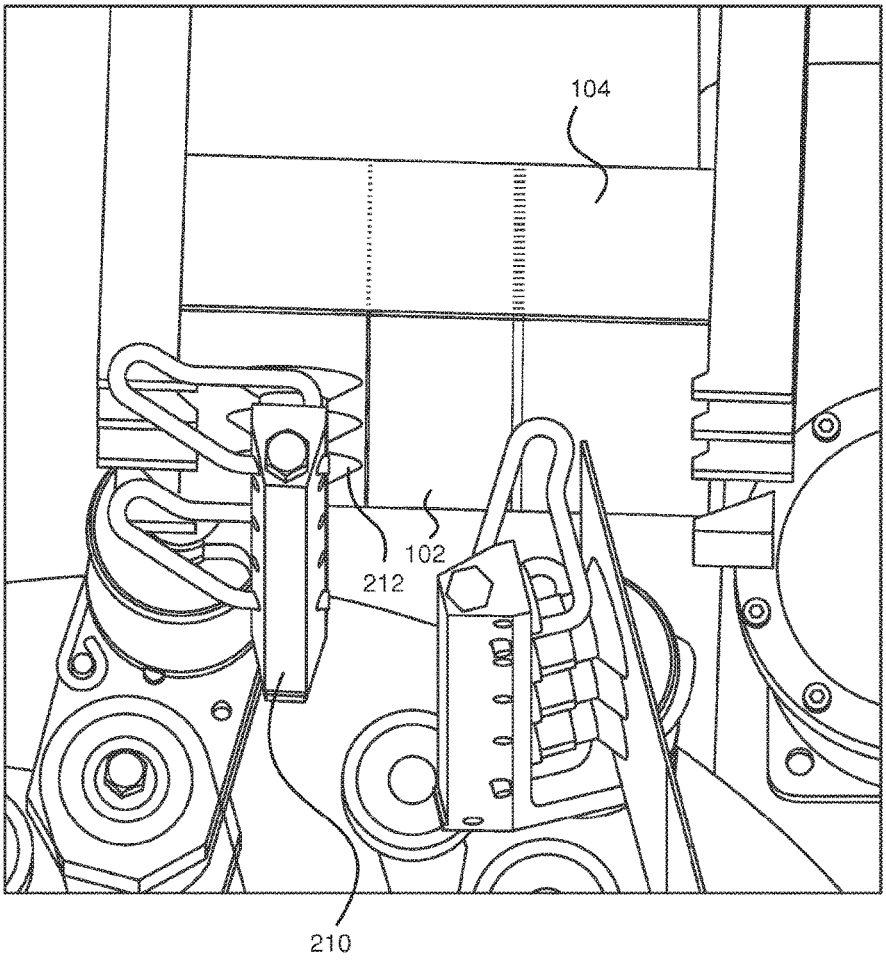

Next, in FIG. 3*b*, the gripper 210 is placed such that the suction cups 212 are parallel to the blank and in contact with this such that the blank can be gripped by pumping out air from cavities formed between the suction cups and the blank.

Figure 3C:
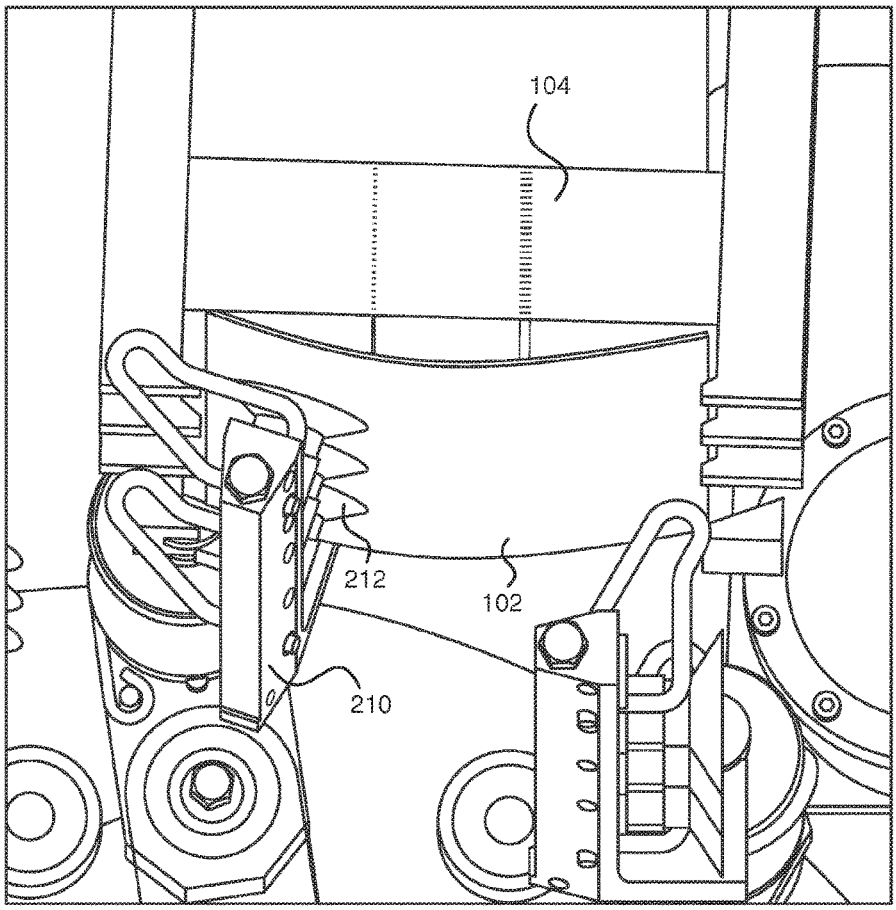

In order to remove the blank from the magasine the blank is bent such that this can be pulled over the protrusions, or hooks, provided for keeping the blanks in place in the magasine. FIG. 3*c* illustrates a situation where the blank has been bent and is just about to be pulled out from the magasine.

Figure 3D:
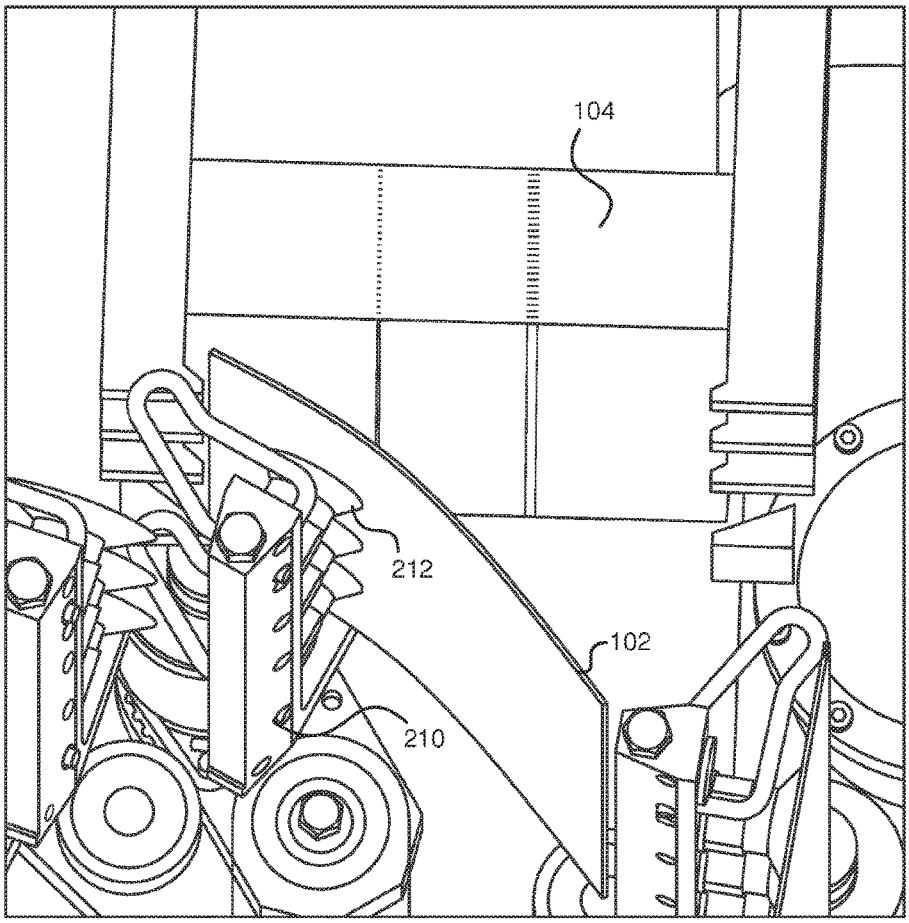

Finally, in FIG. 3*d*, it is shown a situation where the blank has been pulled out from the magasine and is held in place by the suction cups and transported away from the magasine towards, for instance, a carousel 300, as illustrated in FIG. 1.

In order to further illustrate the process of fetching the blank from the magasine, the same process as illustrated in FIG. 3*a-d* is illustrated in FIG. 4*a-d*, but seen from above.

Figure 4A:
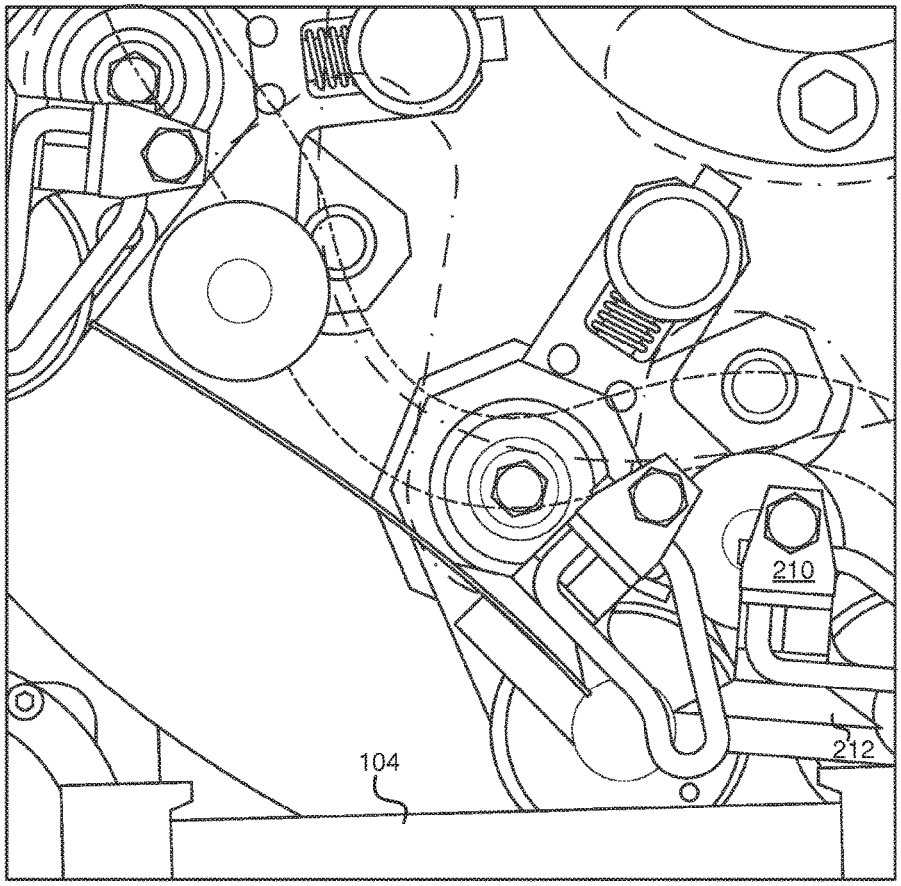
FIG. 4*a-d* is an illustration of the process illustrated in FIG. 3 from a top view.

In FIG. 4*a* it is illustrated how the gripper 210, placed to the right in the figure, is moved towards the blank at the same time as the orientation of the suction cups 212 is changed towards a situation where these are parallel to the blank 102 in the magazine 104.

Figure 4B:
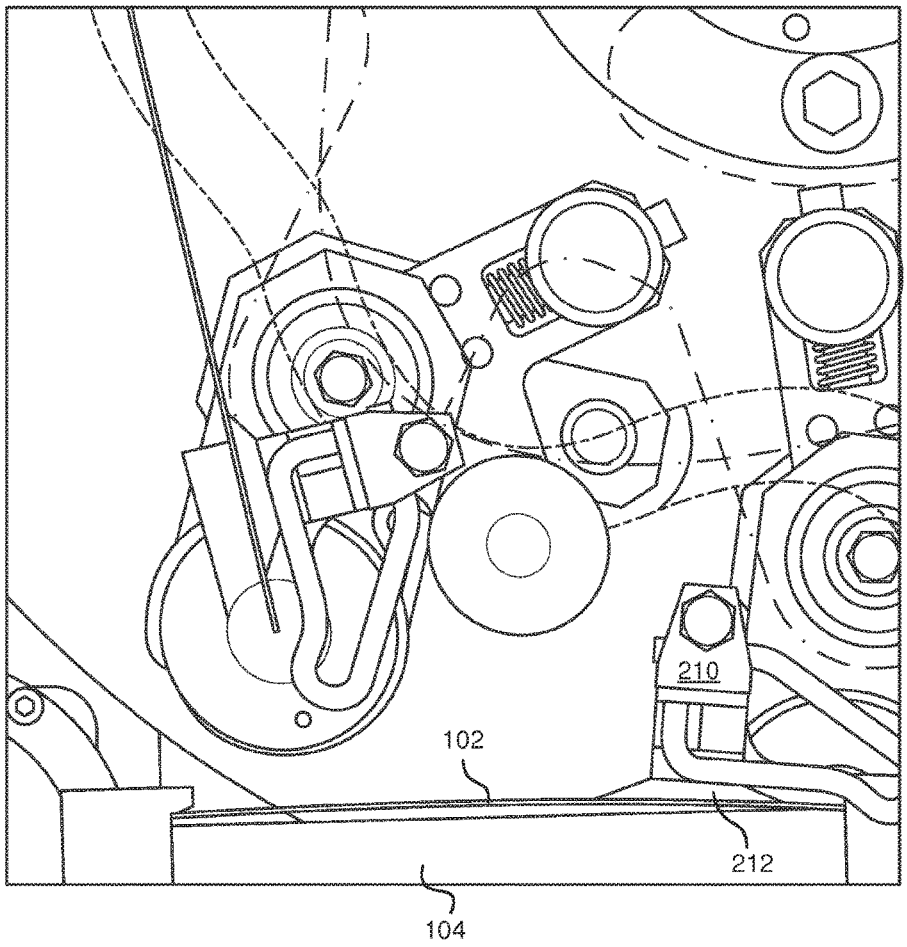

In FIG. 4*b* it is illustrated a situation just after the gripper 210 is placed such that the suction cups 212 are parallel to the blank and in contact with this such that the blank can be gripped by pumping out air from cavities, and a process of pulling out the blank has just started.

Figure 4C:
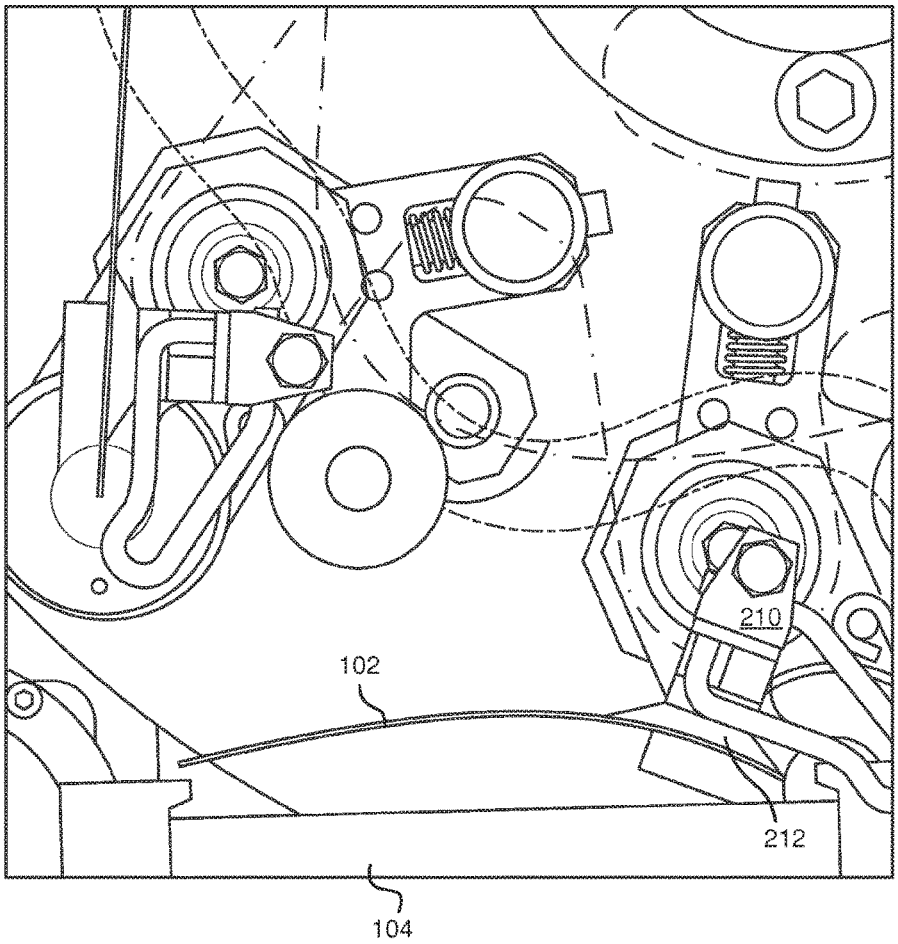

In FIG. 4*c* it is illustrated a situation just after the blank has been removed from the magasine, that is, pulled over the protrusions of the magasine.

Figure 4D:
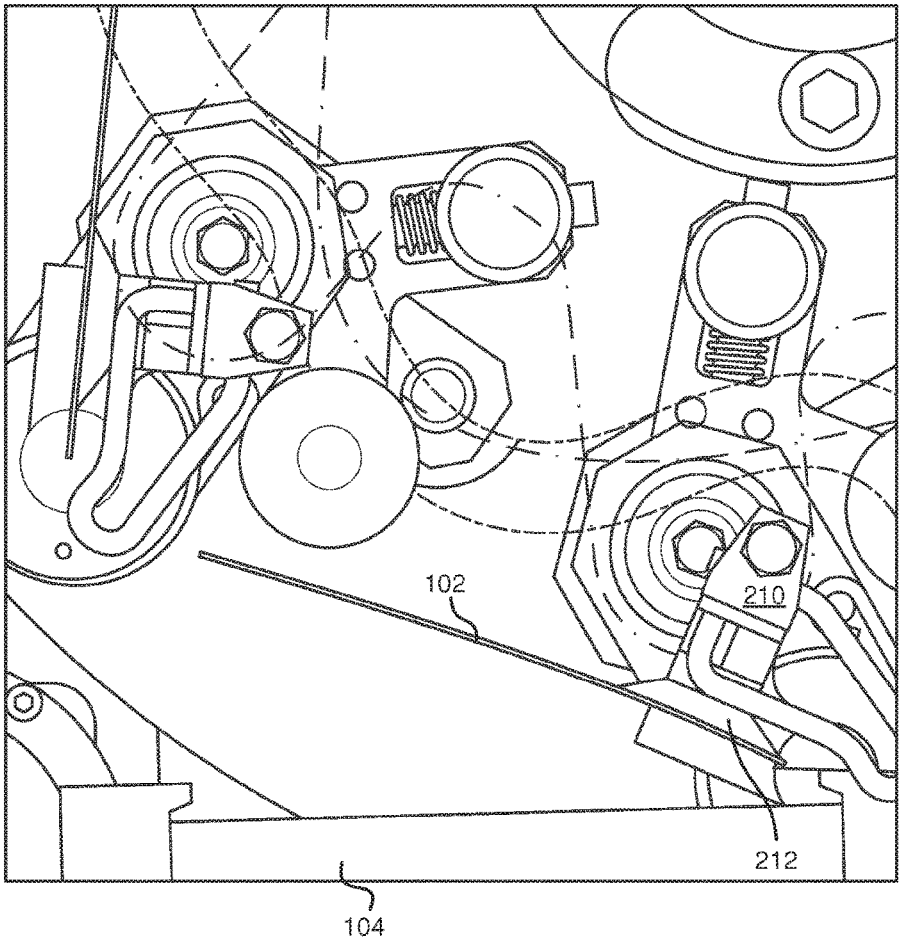

In FIG. 4*d* it is illustrated a situation just after the situation illustrated in FIG. 4*c*. The blank has re-entered its normal shape and is being transported away from the magasine.

Figure 5A:
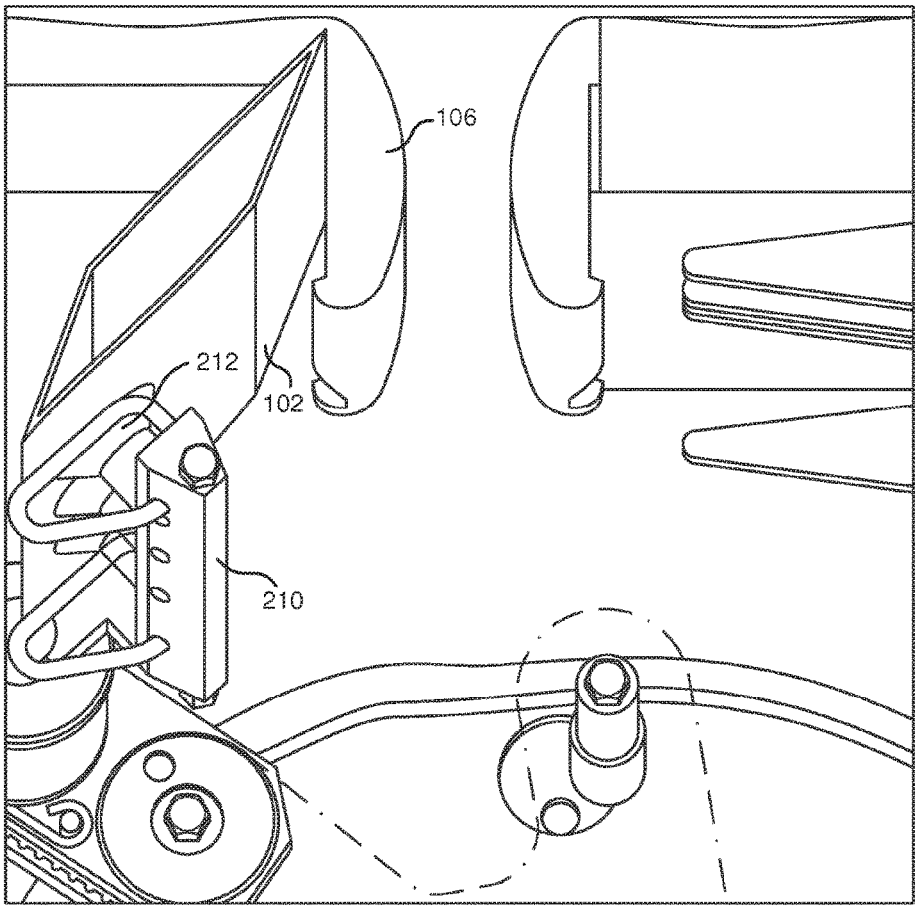
FIG. 5*a-b* is an illustration of a process for placing blanks in carriers.
Figure 5B:
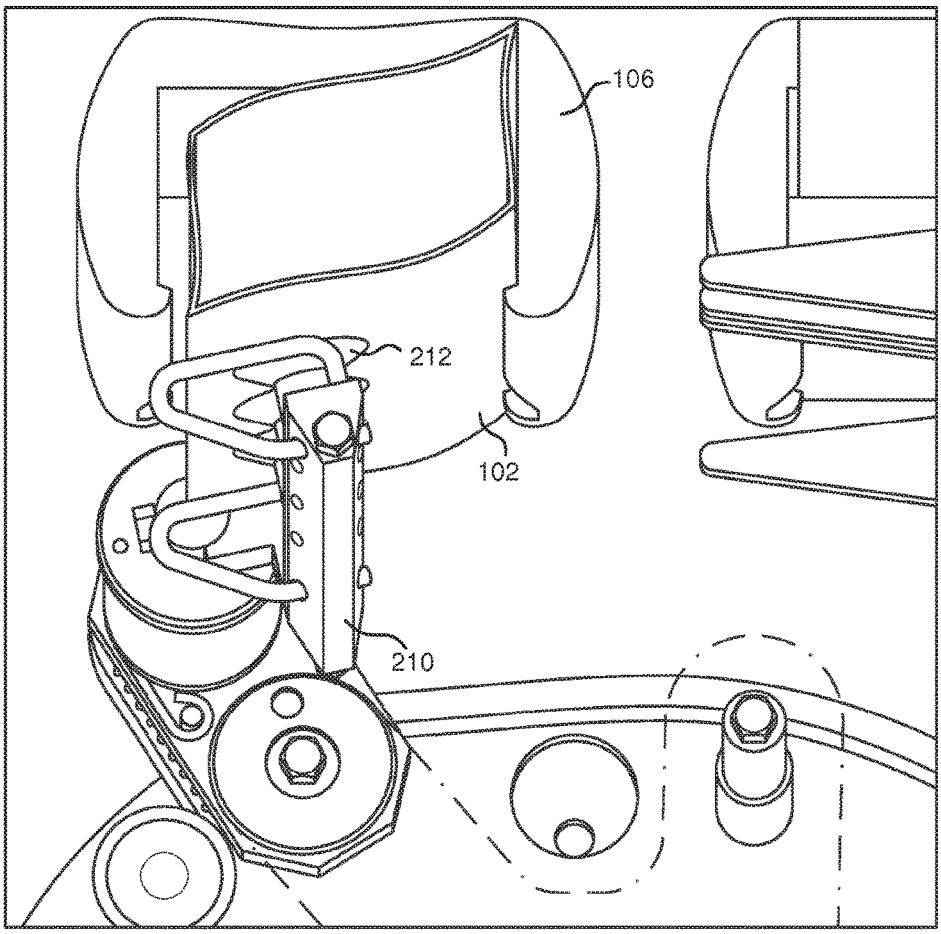

As illustrated in FIG. 1, after having fetched the blank from the magasine and this has been erected by using the carousel 300, the blank can be placed in the carrier 106. FIG. 5*a-b* illustrate more in detail how this can be achieved.

FIG. 5*a* illustrates the gripper 210 holding the blank and inserting this into the carrier 106. By adjusting speed and orientation of the gripper as explained above in relation to FIG. 2 and by adjusting speed of the carrier 106, an outermost part of the blank can be placed in a first corner section of the carrier 106. Thereafter, by using the carrier as a support the blank can be opened up as illustrated in FIG. 5*a*.

FIG. 5*b* illustrates the gripper 210 in a stage taking place just after the stage illustrated in FIG. 5*a*. In comparison with FIG. 5*a*, the carrier has been moved a short distance and the gripper has been moved and reoriented with the effect that the blank has been opened up to a sleeve with two side panels, a front panel and a rear panel. In the situation illustrated in FIG. 5*b* one of the two side panels has been placed in the carrier and the other is just to be put in place.

As illustrated in FIG. 3*a*-3*d* and FIG. 4*a*-4*d* in combination with FIGS. 1 and 2, by having the rotary feeder 200 arranged to rotate around a main rotational (MR) axis the gripper 210 arranged for holding the blank can be moved between a fetching position in which the blank is fetched from the magazine and a releasing position in which the blank is released to a carrier. In order to facilitate a process of fetching the blank from the magazine the gripper can be rotated around a gripper specific rotational (GR) axis. An advantage of having a gripper specific rotation is that before the gripper is to fetch the blank a gripper specific rotational direction may coincide with a main rotational direction such that the gripper head, comprising for instance the vertical shaft 254 and the suction cups 212, is moved towards the magazine both by the rotation of the rotary feeder and the rotation of the gripper, and in that the gripper specific rotational direction and the main rotational direction may be opposite after the gripper has fetched the blank such that a movement of the gripper head away from the magazine caused by the rotation of the rotary feeder is compensated for by the rotation of the gripper. This has the positive effect that a period of time for placing the suction cups correctly and providing for that vacuum is formed can be extended, in turn leading to that the capacity of the rotary feeder can be increased.

In order to further facilitate the fetching of the blank the gripper head may rotate around a gripper head specific rotational (GHR) axis relative to the gripper. By rotating the gripper head around a gripper head rotational axis, it is possible to adjust an orientation of the suction cups 212 such that these are parallel with the blank at a fetching moment.

In order to prevent that the suction cups are folded when placing these onto the blank in the fetching moment it has been realised that when having packages of volumes 250-1000 ml a distance between the gripper head specific rotational GHR axis and the suction cups should be about 20-50 mm.

According to a first alternative aspect, it is provided a rotary feeder for moving articles, such as blanks, comprising a driving unit being connected to at least one gripper having a base structure and a receiving unit, such that the at least one gripper is rotating between a receiving position in which the receiving unit is configured to grip an article, and a releasing position in which the receiving unit is configured to release the article, wherein said rotary feeder further comprises a guide assembly to which the gripper is moveably engaging, wherein the guide assembly comprises a first guiding track defining the angular position of the gripper relative the driving unit, and a second guiding track defining the angular position of the receiving unit relative the base structure.

The base structure may be pivotally connected to the receiving unit, and wherein the receiving unit extends vertically upwards from the base structure.

One end of the base structure may be following the first guiding track, and wherein one end of the receiving unit may be following the second guiding track.

The receiving unit may comprise at least one suction cup.

A vertical axis of the suction cup may coincide with a pivotal axis of the receiving unit.

The receiving unit may be spring biased.

The rotary feeder may comprise a transmission being configured to transmit a relative speed difference between the end of the receiving unit following the second guide track and the driving unit to a corresponding pivotal movement of the suction cup.

According to a second alternative aspect, it is provided a rotary infeed unit, comprising a supply of articles, a plurality of carriers for receiving an associated article, and a rotary feeder according to the first alternative aspect.

The rotary infeed unit may further comprise a carousel having one or more secondary grippers, which secondary grippers are configured to grip an article being transported by the rotary feeder such that a relative change in motion between the rotary feeder and the secondary gripper will cause the article to change its shape.

The plurality of carriers may be arranged on a moving conveyor.

According to a third alternative aspect, it is provided a filling system for packaging of liquid food into individual packages, comprising a rotary infeed unit according to the second alternative aspect.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. An apparatus for fetching a blank from a magazine holding a number of blanks, each of the blanks being a folded planar blank of packaging material that is expandable to a sleeve shaped piece of packaging material, the apparatus comprising:

a rotary feeder that includes a gripper comprised of a base structure and a gripper head, the gripper head including a projecting receiving structure that projects from the base structure and a suction cup mounted on the projecting receiving structure to grip one of the blanks, the rotary feeder and the gripper both being rotatable around a main rotational axis to move the gripper between a fetching position in which a blank is fetched and held by the suction cup and a releasing position in which the blank held by the suction cup is released, the gripper also being rotatable about a gripper specific rotational axis, different from the main rotational axis, to facilitate fetching of the blank when the gripper is in the fetching position, said gripper head being arranged to rotate around a gripper head specific rotational axis, the gripper head specific rotational axis being different from the gripper specific rotational axis; and a guide assembly fixedly attached to a frame, the guide assembly comprising a first guiding track and a second guiding track that are spaced apart from one another, the first and second guiding tracks each forming respective non-circular first and second cam curves, the first cam curve being a gripper head cam curve for controlling rotation of said gripper head around said gripper head specific rotational axis when said rotary feeder is rotated around said main rotational axis, the second cam curve being a gripper cam curve for controlling rotation of said gripper around said gripper specific rotational axis when said rotary feeder is rotated around said main rotational axis, the projecting receiving structure including a first roller that is in contacting engagement with the first cam curve of the first guiding track, and the base structure including a second roller that is in contacting engagement with the second cam curve of the second guiding track.

2. The apparatus according to claim 1, wherein the first cam curve of the first guiding track is an outer periphery of a part of the guide assembly.

3. The apparatus according to claim 1, wherein the second cam curve of the second guiding track is groove formed in a part of the guide assembly.

4. The apparatus according to claim 1, wherein there are a plurality of suction cups mounted on the projecting receiving structure in a spaced apart manner.

5. The apparatus according to claim 1, further comprising a spring that provides a spring-bias on the projecting receiving structure such that rotation in a first direction of the the projecting receiving structure iscounteracted by a spring force of the spring.

6. The apparatus according to claim 2, wherein the second cam curve of the second guiding track is groove formed in a part of the guide assembly.

7. The apparatus according to claim 6, wherein there are a plurality of suction cups mounted on the projecting receiving structure in a spaced apart manner.

8. The apparatus according to claim 5, wherein, the spring force provides the spring bias on the projecting receiving structure such that the first roller is constantly pressed against the first cam curve of the first guiding track.

9. The apparatus according to claim 8, wherein the spring provides a further spring-bias on the base structure such that the second roller is pressed against the outside of the second cam curve of the second guiding track.

* * * * *